US005343002A

United States Patent [19]

Gremillion

[11] Patent Number: 5,343,002

[45] Date of Patent: Aug. 30, 1994

[54] DISPOSABLE POINT WITH EXPLOSIVE CHARGE FOR SEISMIC EXPLORATION

[75] Inventor: Richard A. Gremillion, Cut Off, La.

[73] Assignee: Ernest J. Gremillion, Cut Off, La. ; a part interest

[21] Appl. No.: 970,855

[22] Filed: Nov. 3, 1992

[51] Int. Cl.[5] ..... G01V 1/06

[52] U.S. Cl. ..... 181/116; 181/106; 102/313; 102/319

[58] Field of Search ..... 181/106, 116; 102/313, 102/319

[56] References Cited

U.S. PATENT DOCUMENTS

| | | | |
|---|---|---|---|
| 3,242,999 | 3/1966 | Garner | 175/19 |
| 3,394,766 | 7/1968 | Lebelle | 173/49 |
| 3,920,083 | 11/1975 | Makita | 173/49 |
| 4,278,025 | 7/1981 | McReynolds | 181/116 |
| 4,471,669 | 9/1984 | Seaberg | 74/687 |
| 4,546,703 | 10/1985 | Thompson | 102/313 |
| 4,553,443 | 11/1985 | Rossfelder et al. | 74/22 |
| 4,819,740 | 4/1989 | Warrington | 173/49 |

*Primary Examiner*—J. Woodrow Eldred

*Attorney, Agent, or Firm*—Jacobson, Price, Holman & Stern

[57] ABSTRACT

A disposable point detachably mounted on the lower end of a vertically movable hole forming elongated member with the point having an explosive charge mounted therein in order for the disposable point and explosive charge to remain in the bottom of a hole formed by the elongated member and point when they are forced into a subsurface formation which is to be seismically explored with the elongated member then being retracted.

16 Claims, 3 Drawing Sheets

DISPOSABLE POINT WITH EXPLOSIVE CHARGE FOR SEISMIC EXPLORATION

BACKGROUND OF THE INVENTION

1. FIELD OF THE INVENTION

The present invention generally relates to seismic exploration and more particularly to a disposable point detachably mounted on the lower end of a vertically movable hole forming elongated member and having an explosive charge mounted therein in order for the disposable point to remain in the bottom of a hole formed by the elongated member and point when they are forced into a subsurface formation which is to be seismically explored.

2. DESCRIPTION OF THE PRIOR ART

As is well known, seismic exploration of underground formations is conducted by positioning a plurality of explosive seismic charges below ground level at a designated depth and in a designated pattern with these charges being subsequently detonated to produce seismograph recordings which can be analyzed to determine the character of the underground formation including whether the underground strata includes potentially recoverable oil or gas deposits and the like. Various devices have been provided to form vertical bores or holes in the earth's surface in which seismic charges are placed and detonated. The following U.S. patents relate to this field of endeavor and include devices for forming vertically extending holes in the surface of the earth. 3,394,766 3,920,083 4,471,669 4,553,443 4,819,740

The above patents do not disclose a disposable point having an explosive charge therein which is detachably mounted on the lower end of an elongated member which forms a hole or bore in the earth with the point and explosive charge remaining at the bottom of the hole when the elongated member is retracted from the hole.

SUMMARY OF THE INVENTION

An object of the present invention is to provide a disposable point having an explosive charge mounted thereon for insertion of the seismic charge below ground level to a designated depth to facilitate production of seismograph recordings which includes a disposable point on the lower end of a hole forming elongated member which can be forced downwardly into the earth to a predetermined desired depth with the elongated member then being retracted and the point and charge remaining at the bottom of the hole.

A further object of the invention is to provide a disposable point releaseably mounted on the lower end of a hole forming elongated member with the point including a hollow interior in which an explosive charge is mounted with the disposable point and explosive charge mounted therein remaining at the bottom of the hole when penetration to a desired depth has occurred at which time the hole forming elongated member is retracted with the detachable connection between the disposable point and the elongated member enabling the disposable point to remain at the bottom of the formation penetrating hole.

Another object of the invention is to provide a disposable and detachable point as previously set forth which includes outwardly pivoted wings which pivot outwardly to anchor the point when the elongated member is retracted with the point also including a secondary anchoring hook.

Still another object of the invention is to provide a disposable point as set forth in the preceding objects in which the structures cooperate to efficiently position an explosive seismic charge in a desired location and at a desired depth with the point being relatively inexpensive to construct to render it economically disposable.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
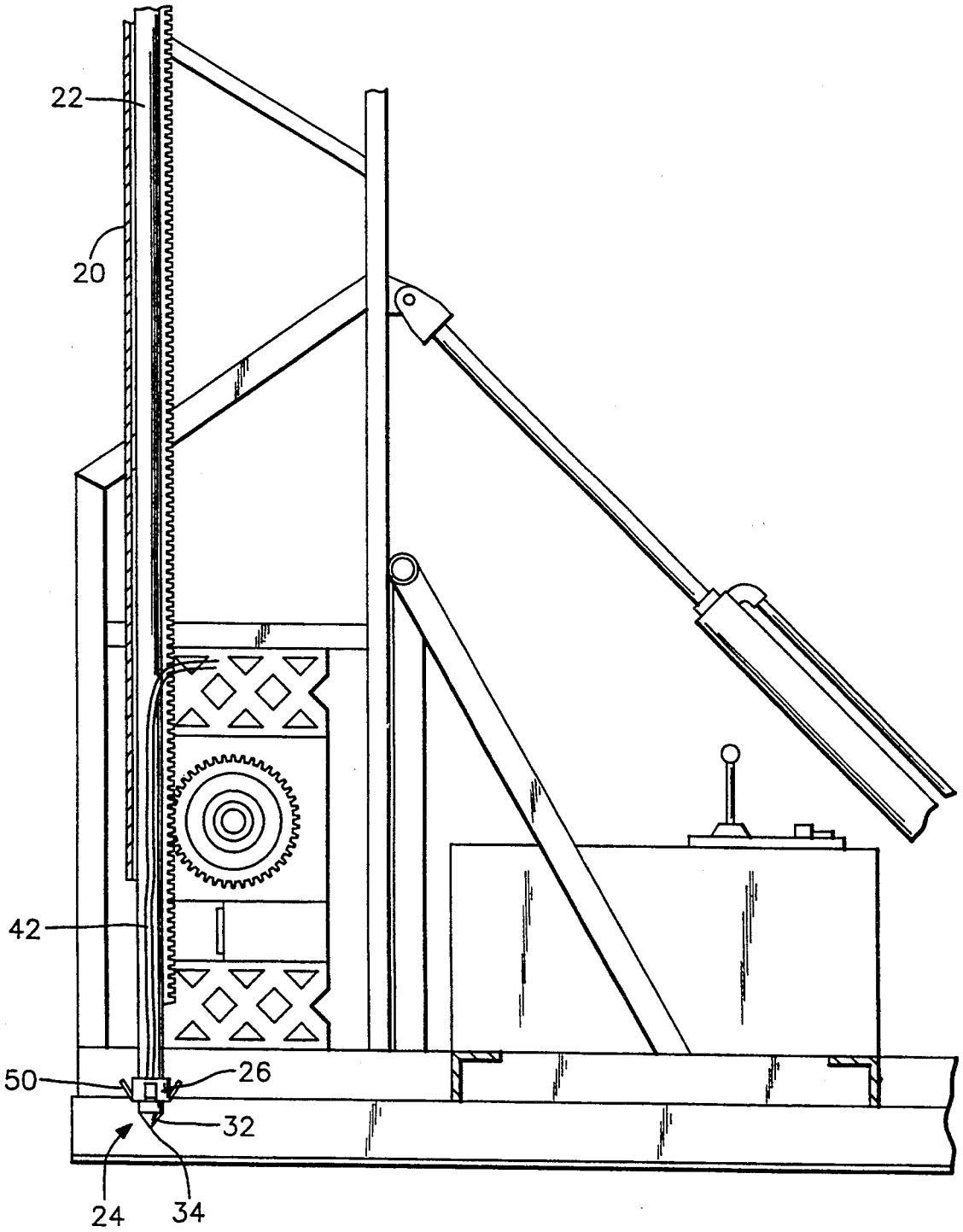
FIG. 1 is a fragmental vertical sectional view of a hole forming device having a vertically moving elongated member with the disposable point and explosive charge of the present invention mounted on the lower end.
Figure 2:
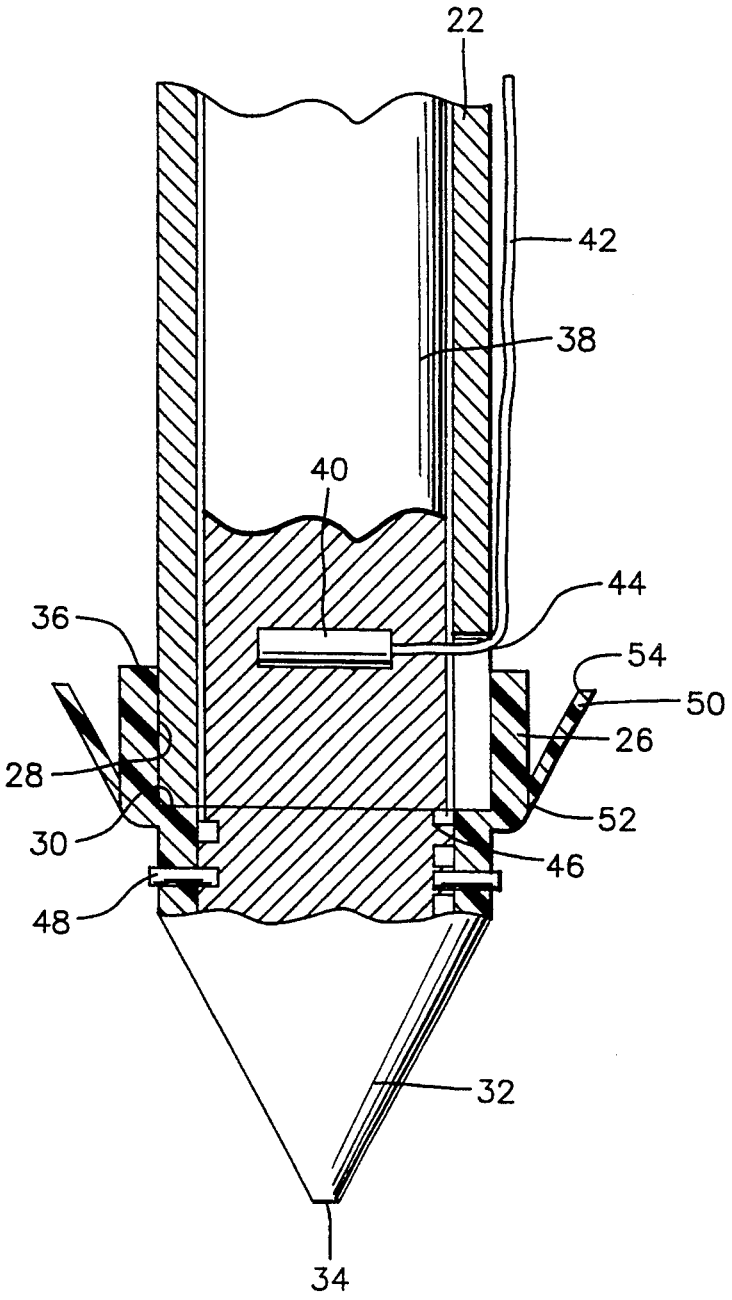
FIG. 2 is a detailed vertical sectional view, on an enlarged scale, illustrating the disposable point and explosive charge incorporated therein and including the structure for connecting the disposable point to the lower end of the elongated member and anchoring the point in the hole.

Referring to the drawings, a hole forming device is schematically illustrated in FIG. 1 which includes an elongated rigid tubular guide tube or sleeve 20 which guidingly supports an elongated vertically movable member which may be in the form of a pipe 22 therein. The pipe 22 mounts and detachably supports a disposable point 24 on the lower end thereof.

As illustrated, the disposable point 24 is mounted on the lower end of the pipe 22. The point 24 includes a stepped cylindrical body 26 having a recessed inner surface 28 at its upper end which forms a radial shoulder 30 at its inner end. The recessed surface 28 telescopes over the lower end of the pipe 22 and is frictionally but loosely retained in position thereon. The lower end of the cylindrical body 26 includes a tapering portion 32 which has a lower end forming a penetrating point 34. As illustrated, the diameter of the cylindrical body 26 is greater than the diameter of the pipe 22 thus defining a radial shoulder 36 outwardly of the pipe 22. This structure enables the disposable point 24 to remain in the hole that was formed since the disposable point 24 is loosely mounted on the lower end of the pipe 22 with a small amount of friction therebetween retaining the point in place until it is lowered into contact with the ground surface. As the pipe and point reach the desired depth, the shoulder 36 will engage the periphery of the hole and retain the point 24 in place in the bottom of the hole as the pipe 22 is retracted or moved upwardly. The tapered construction of the lower end of the point combined with the periphery of the cylindrical body 26 creates a suction or vacuum below itself and together with the shoulder 36 assures that the point will be released from the pipe and remain at the base of the hole when the retracting movement of the pipe 22 commences.

To assure that the point 24 will remain in the bottom of the hole, a plurality of anchoring wings 50 are formed integrally on the body 26 and connected thereto by living hinge areas 52. The point body 26 and wings 50 are of one-piece molded plastic (PVC) with memory characteristics. The wings 50 are on the outside of body 26 and, when molded, the wings are inclined outwardly but can flex inwardly toward the body 26 when the point is moving downwardly. As pipe 22 moves upwardly, the wings 50 move back toward their original position and engage the wall of the hole. The upper ends of the wings 50 are beveled at 54 to assist in anchoring the wings to the wall of the hole to separate the point 24 from pipe 22. The hole is usually only slightly larger than the point and may be irregular in cross-sectional configuration. However, the flexibility of the wings and their memory characteristics will assure that the upper ends 54 of the wings will effectively engage the wall of the hole and separate the point and attached explosive charge from the pipe in order for the point and charge to remain at the bottom of the hole.

Mounted interiorly of the cylindrical body 26 is an explosive charge 38 having a blasting cap 40 incorporated therein with the blasting cap having a blasting cap wire or detonation wire 42 attached thereto and extending outwardly of the explosive charge 38 and through a notch 44 in the bottom edge portion of the pipe 22. The notch 44 extends above the shoulder 36 and the larger diameter of the cylindrical body 26 will provide a space in the hole being formed for the cap wire 42 thus assuring that the cap wire 42 will not be dislodged from the blasting cap 40. The explosive charge 38 is partially telescoped into the lower end of the pipe 22 but is connected with the interior of the disposable point 26 thereby assuring that it will stay with the point at the bottom of the whole.

Figure 3:
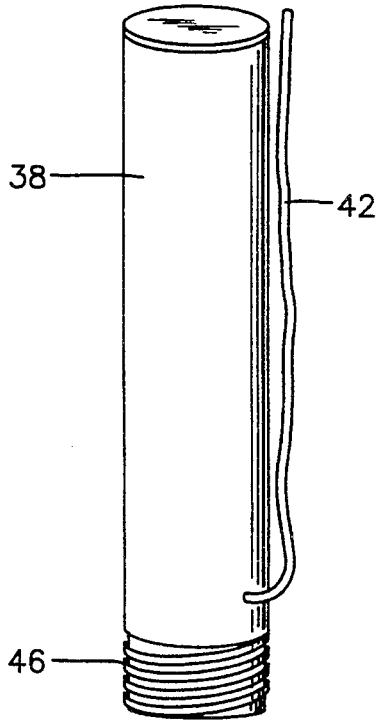
FIG. 3 is a perspective view of the explosive charge which is mounted interiorly of the disposable point.
Figure 4:
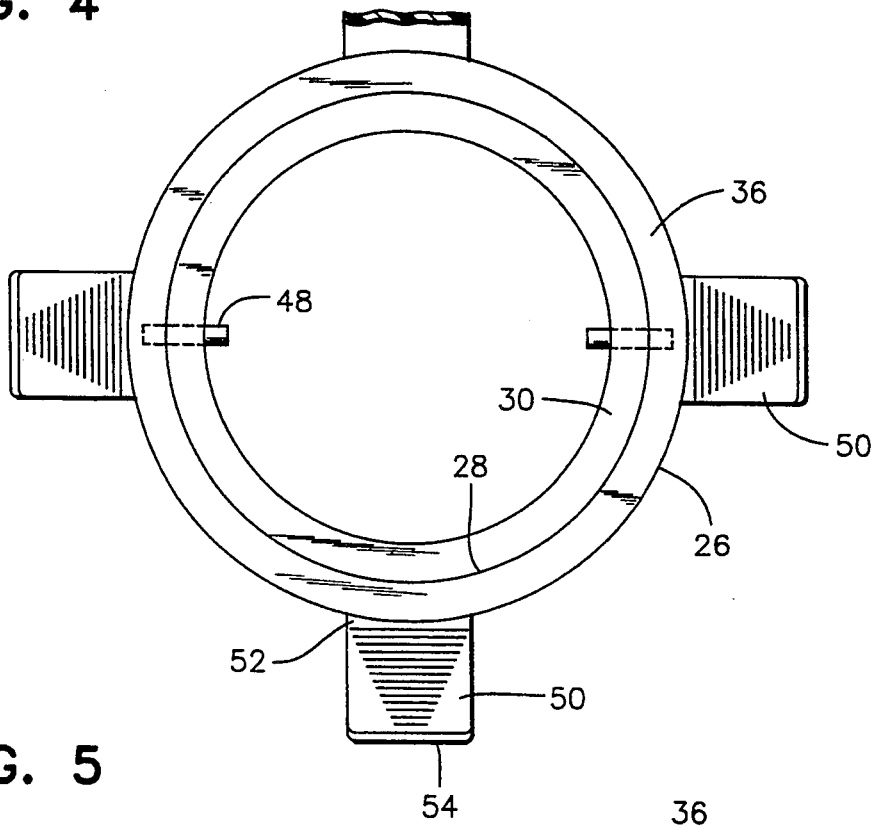
FIG. 4 is an end elevational view of the disposable point.
Figure 5:
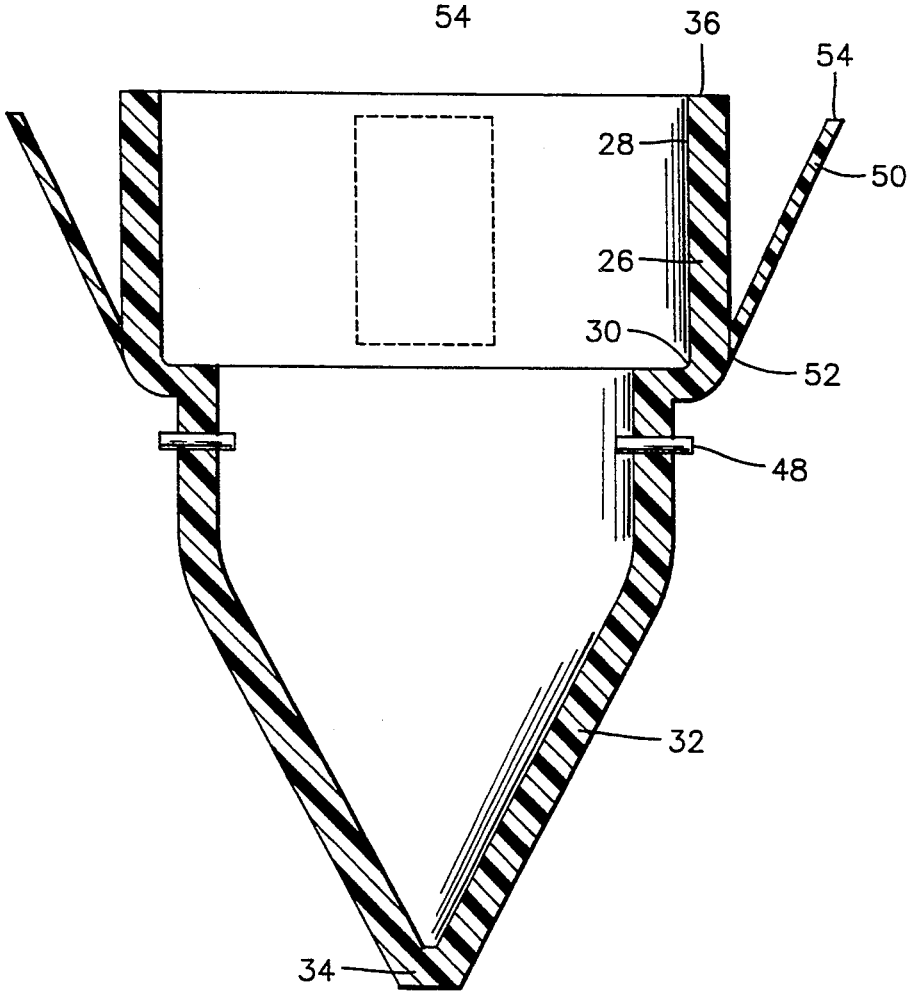
FIG. 5 is a sectional view of the disposable point.

The explosive charge 38 is a preformed rigid, generally cylindrical structure as illustrated in FIG. 3 and is provided with spiral threads 46 at its lower end with the threads being cut into the external surface of the cylindrical charge 38. The interior of the cylindrical body 26 receives the lower end of the charge 38 and the interior of the body 26 below shoulder 30 is provided with a pair of opposed projecting pins or detents 48 which are diametrically opposed and offset in relation to each other to be received in the threads 46. Thus, the detents 48 cooperate with the threads 46 to form a threaded connection between the charge 38 and the cylindrical body 26. The detents 48, in effect, provide partial internal threads which engage the external threads 46 with the short circumferential extent of the detents 48 facilitating engagement of the threads 46 with the interior of the cylindrical body 26.

The cylindrical body 26 and wings 50 are constructed of plastic material and the external diameter of the cylindrical body 26 may be approximately ½" more than the external diameter of the pipe 22. The pipe 22 may be a conventional pipe of any necessary length and outside diameter and the overall length of the disposable point may be 7" or 8" with the recess 28 being 1" to 2" in length and the length of the tapered end may be approximately 3½" in length.

Other elongated members may be used in lieu of pipe 22 and variations in the size of the components may vary from that shown in the drawings. Also, devices other than seismic charges can be mounted on the point 24 such as seismic phones, jet hose or any other device which is utilized at the bottom of a hole or bore formed in the surface of the earth.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A disposable point with explosive charge for mounting on the lower end of a non-rotatable vertically supported, reciprocally mounted, elongated, rigid hole forming member which forms a hole by displacing earth laterally by compressing the earth as the hole forming member is driven downwardly, said point including a generally cylindrical body, an explosive charge connected to and protected by said body, said body including an end recess telescopically and detachably mounted on said hole forming member for separation of the point from said hole forming member when said hole forming member is retracted thereby leaving the point and explosive charge in said hole.

2. The disposable point as defined in claim 1 wherein said explosive charge includes external thread means on an end portion thereof, said recess in the body including means engaged with the thread mean on the charge to mount the charge on the body.

3. The disposable point as defined in claim i wherein said cylindrical body has an external diameter greater than the hole forming member, said recess telescopically receiving the lower end of the hole forming member providing engagement therebetween enabling easy separation of the cylindrical body from the hole forming member when retracted, said cylindrical body including means to engage sidewall portions of the hole formed by the point to retain the point in the bottom of the hole.

4. The disposable point as defined in claim 3 wherein said means to engage sidewall portions of the hole includes at least one anchor wing pivotally connected to said body to enable the wing to pivot between a position alongside the body to a position diverging upwardly from the body to anchor the disposable point.

5. The disposable point as defined in claim 3 wherein said means to engage sidewall portions of the hole includes a radially extending shoulder forming the upper end of said cylindrical body, said shoulder extending outwardly from a periphery of said hole forming member for engaging sidewall portions of the hole when the hole forming member is retracted.

6. The disposable point as defined in claim 4 wherein said body and anchor wing are constructed unitarily of plastic material having memory characteristics with the wings being formed in upwardly diverging relation to said body.

7. The disposable point as defined in claim 5 wherein said means to engage sidewall portions of the hole includes a plurality of anchor wings pivotally connected to said body to enable the wings to pivot between a position alongside the body to a position diverging from the body to anchor the disposable point.

8. In combination, an elongated, rigid hole forming member adapted to be moved downwardly into the surface of the earth to form a hole and then retracted from the hole, a disposable point mounted on a lower end of said hole forming member when it is moved downwardly to form the hole, means mounting said point detachably to said hole forming member, means on said point engaging a sidewall portion of the hole when the hole forming member is retracted to separate the point from the hole forming member thereby enabling the point to remain in the bottom of the hole, said point including a body having a cavity receiving and supporting a functional unit which is retained in the bottom of the hole by said body.

9. The combination as defined in claim 8 wherein said functional unit is an explosive charge for use in seismic exploration.

10. The disposable point as defined in claim 9 wherein said explosive charge includes a detonating cap therein, detonating wires extending from said cap to the exterior of the charge, said hole forming member including a hollow lower end receiving a portion of said charge, said hollow end including an upwardly extending notch extending upwardly to a point just above the upper end of said body thereby enabling the wires to extend to the exterior of said hole forming member just above the upper end of said body.

11. The combination as defined in claim 8 wherein said means engaging a sidewall portion of the hole includes a plurality of anchoring pivotally mounted on said point.

12. The combination as defined in claim 11 wherein said body and wings are constructed unitarily of plastic material with the wings being flexibly connected to said body and extending normally upwardly and outwardly therefrom to engage a sidewall portion of the hole.

13. The combination as defined in claim 8 wherein said means on said point engaging a side wall portion of the hole includes a radially extending , upwardly facing peripheral shoulder forming an upper end of said body, said shoulder extending outwardly from a periphery of said hole forming member for engaging side wall portions of the hole when the hole forming member is retracted thereby leaving the point and the functional unit in said hole.

14. The combination as defined in claim 13 wherein said cavity and functional unit include coacting means to mount the functional unit in the cavity for protection when the hole forming member is being moved downwardly into the earth to form a hole, said body also including an upwardly opening recess telescopically receiving a lower end of the hole forming member with the telescopic association mounting the point on the hole forming member and enabling easy separation of the point from the hole forming member when the hole forming member is retracted.

15. The combination as defined in claim 8 wherein said functional unit includes wire means connected thereto and extending upwardly in relation to the hole forming member to ground surface without being attached to the hole forming member whereby the wires remain in place in the hole and connected to the functional unit when the hole forming member is retracted.

16. The combination as defined in claim 8 wherein said functional unit is used is seismic exploration and is in the form of an explosive charge or geophone.

* * * * *